United States Patent [19]

Ohishi

[11] 4,267,048

[45] May 12, 1981

[54] EQUIPMENT FOR SEPARATING FOREIGN MATTER FROM LIQUID PAPERMAKING MATERIALS

[75] Inventor: Saburo Ohishi, Shizuoka, Japan

[73] Assignee: Oishikikai Mfg. Co., Ltd., Shizuoka, Japan

[21] Appl. No.: 19,631

[22] Filed: Mar. 12, 1979

[51] Int. Cl.[3] ..... B04C 5/28

[52] U.S. Cl. ..... 210/512.2; 209/211

[58] Field of Search ..... 210/512 M, 512 R; 209/211, 144; 55/349

[56] References Cited

U.S. PATENT DOCUMENTS

| | | | |
|---|---|---|---|
| 3,235,090 | 2/1966 | Bose et al. | 209/144 |
| 3,366,247 | 1/1968 | Visman | 210/512 M |
| 3,543,931 | 12/1970 | Rastatter | 210/512 M |
| 3,543,932 | 12/1970 | Rastatter | 210/512 M |
| 3,696,934 | 10/1972 | Oisi | 210/512 R |
| 3,764,005 | 10/1973 | Zemanek | 210/512 R |
| 3,893,922 | 7/1975 | Bobo | 210/512 M |
| 3,989,628 | 11/1976 | Bier | 210/512 M |
| 4,148,721 | 4/1979 | Brown et al. | 210/512 M |
| 4,151,083 | 4/1979 | Dove | 209/211 |

*Primary Examiner*—Theodore A. Granger

*Attorney, Agent, or Firm*—Cantor and Singer

[57] ABSTRACT

Equipment for continuously separating foreign matters from unpurified liquid papermaking materials. Cyclone separators are disposed radially around and equidistantly from a central structure. Each of these cyclone separators has a chamber for collecting purified liquid papermaking materials, a cyclone chamber for separating liquid papermaking materials, and a cyclone vortex chamber for separating heavy foreign matter further into relatively light foreign matter and relatively heavy foreign matter, these chambers being disposed in this order from above. The central structure is partitioned into intermediate chambers. Main pipes enter respective intermediate chambers which are connected by brach pipes to the chambers of all the cyclone separators. Secondary cyclone separators, about the same in construction as the cyclone separators, receive the above-mentioned relatively heavy foreign matter and separate them again.

4 Claims, 3 Drawing Figures

EQUIPMENT FOR SEPARATING FOREIGN MATTER FROM LIQUID PAPERMAKING MATERIALS

BACKGROUND OF THE INVENTION

The present invention relates to equipment for continuously separating foreign matter from unpurified liquid papermaking materials.

Unpurified liquid papermaking materials contain unnecessary things besides fibers. Recently in particular, such unnecessary things have become more and more diversified because papermaking materials have become richer in variety and utilization has been made of, for instance, wastepaper. There has been almost no equipment that can remove all this diversified foreign matter at one time. Previous efforts to cope with the diversification of foreign matter have included the separate use of two different types of equipment, one for removing light foreign matter and the other for removing heavy foreign matter. This has had the disadvantage that it involves great cost of equipment and needs a large space therefor. On the other hand, cyclone separators are limited in size because of their function. Therefore, several cyclone separators have been used at the same time if liquid papermaking materials are to be handled in quantity. Also in this case, the above-mentioned disadvantages have been inevitable. Furthermore, the cyclone separators have been arranged in a row and pipes for the supply of liquid papermaking materials, etc. have branched off to them, but the distances between the branch point and the cyclone separators have been different. Therefore, even if the cyclone separators are adjusted to the same operating conditions, they have not always performed uniform separating action and they have often given uneven purification. To obtain uniform purification, each cyclone separator has had to be adjusted individually. This adjustment has been very difficult to make, and it has been impossible to make it perfectly. As a result, it has been impossible to purify liquid papermaking materials satisfactorily.

SUMMARY OF THE INVENTION

It is therefore a main object of this invention to provide equipment which obviates all the above-mentioned disadvantages.

It is another object of this invention to provide equipment which effectively removes heavy foreign matter from unpurified liquid papermaking materials.

It is still another specific object of this invention to provide equipment which further separates the heavy foreign matter into relatively light matter and relatively heavy matter.

It is an additional object of this invention to provide equipment which collects said relatively light foreign matter and puts them in new liquid papermaking materials to be purified in order to obtain a better yield.

It is an additional object of this invention to provide equipment which collects said relatively heavy matter and separates it again to increase the accuracy of separation.

It is an additional object of this invention to provide equipment which removes not only said heavy foreign matter but also light foreign matter from unpurified liquid paper-making materials.

It is an additional object of this invention to provide equipment which makes separating action uniformly under the same conditions and with a high accuracy.

It is an additional object of this invention to provide equipment which re-collects foreign matter in a uniform state.

It is an additional object of this invention to minimize the space and number of parts necessary for such equipment.

These and other objects and advantages of the invention will appear more fully from the following description.

DETAILED DESCRIPTION OF THE INVENTION

Figure 1:
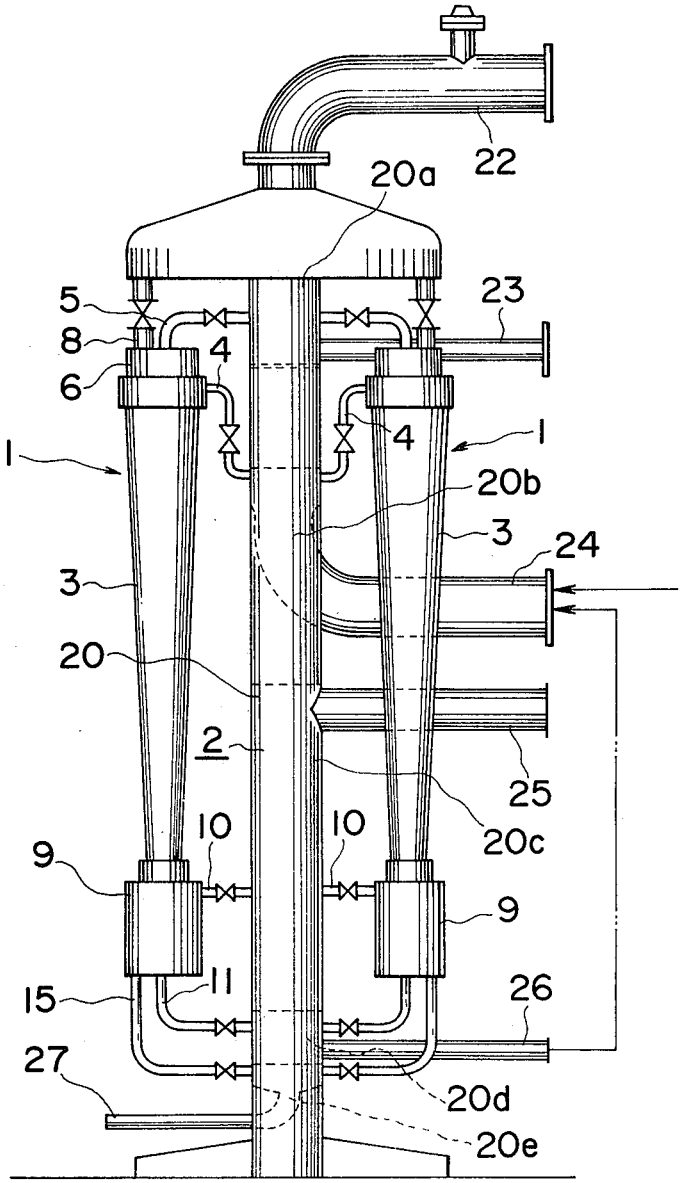
FIG. 1 is a side view illustrating an embodiment of the present invention.
Figure 2:
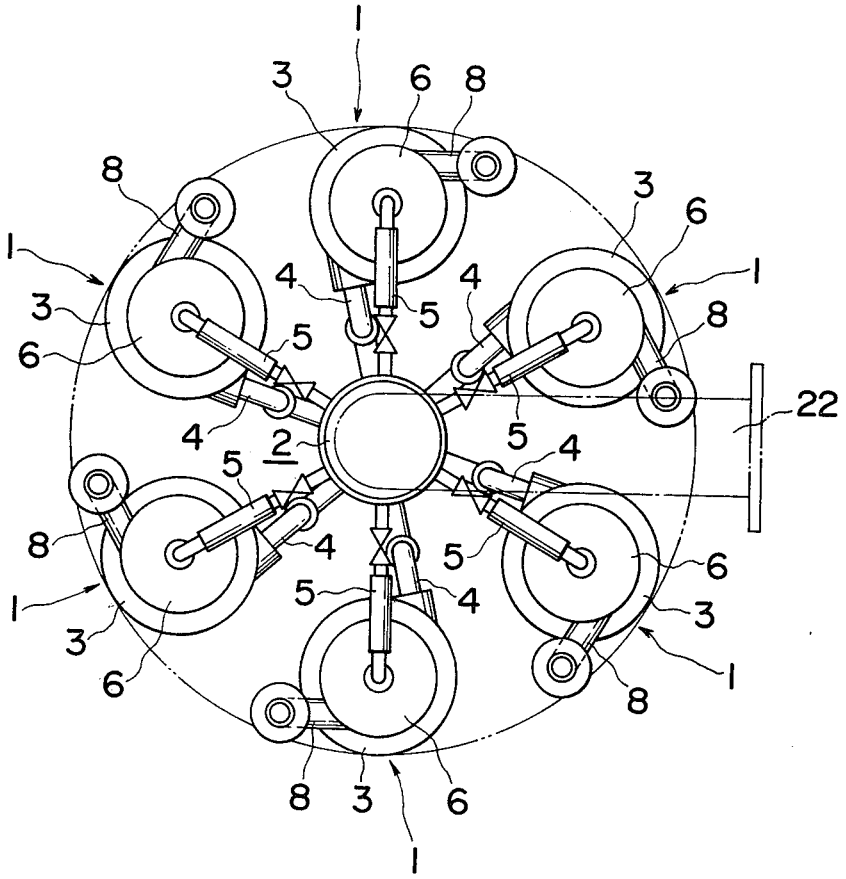
FIG. 2 is a plan view illustrating the same.

The present invention will now be concretely described with reference to embodiments illustrated in the drawings. In FIGS. 1 and 2, numeral 1 represents a cyclone separator. A plurality of cyclone separators (six in FIG. 2) are disposed, for instance, radially around and equidistantly from a central structure 2. Referring first to the cyclone separator 1, this has a separator body 3 tapering toward the bottom, and a supply pipe 4 for liquid papermaking materials tangentially connected to its upper portion. An exhaust pipe 5 for light foreign matter comes from above into the upper central portion of a cyclone chamber 3*a* with its open end positioned slightly lower than the above-mentioned supply pipe 4 for liquid papermaking materials. A collecting chamber 6 for liquid papermaking materials is disposed at the top of the separator body 3, and is connected to the cyclone chamber 3*a* by a collecting nozzle 7 which surrounds said exhaust pipe 5 for light foreign matter. By the way, the exhaust pipe 5, which is provided for removing light foreign matter as mentioned later, is not necessarily inevitable to this invention. This is because of the fact that, in some kinds of liquid papermaking materials, light foreign matter has almost no ill effect and does not have to be removed. What is necessary in this connection is only to take out heavy foreign matter that has ill effects and further separate it into two fractions; relatively light matter and relatively heavy matter. A collecting pipe 8 extends tangentially, for instance, out of the collecting chamber 6. The routes of the collecting pipe 8 and exhaust pipe 5 will be described later.

Referring next to a cyclone vortex chamber 9 disposed under the separator body 3, this is substantially cylindrical in shape and is connected at its central top to the cyclone chamber 3*a*. A pressurized fresh water supply pipe 10 enters the cyclone vortex chamber 9 tangentially at its upper portion. The bottom of the cyclone vortex chamber 9 has a re-collecting port 11 at the center, an accumulating portion 12 for waste disposed around and slightly lower than the re-collecting port 11, and an outlet port 13 in the accumulating portion 12. A re-collecting pipe 14 is connected to the re-collecting port 11, and an outlet pipe 15 is connected to the outlet port 13. Incidentally, each of these pipes is fitted with a valve in a conventional manner.

Referring now to the aforesaid central structure 2, this is a hollow structure with, for instance, circular cross section, and is partitioned into a plurality of intermediate chambers 20 disposed one on top of the other. These intermediate chambers 20, designated 20*a*, 20*b*, 20*c* etc. for identification, are arranged, for instance, in the following order from above: an intermediate chamber 20*a* for accumulating light foreign matter, intermediate chamber 20*b* for distributing liquid papermaking materials, intermediate chamber 20*c* for supplying pressurized clear water, intermediate chamber 20*d* for recollection, and intermediate outlet chamber 20*e*. A collecting intermediate tank 21 is provided at the top of the central structure 2. All the collecting pipes 8 from all the cyclone separators 1 enter the collecting intermediate tank 21, while a main collecting pipe 22 is connected to it at its central top. The intermediate chamber 20*a* under the collecting intermediate tank 21 is connected both to all the exhaust pipes 5 for light foreign matter extending from all the cyclone separators 1 and to a main exhaust pipe 23 for light foreign matter. The intermediate chamber 20*b* for distributing liquid papermaking materials located under the intermediate chamber 20*a* is connected both to all the supply pipes 4 for liquid papermaking materials extending to all the cyclone separators 1 and to a main supply pipe 24 for liquid papermaking materials. An elbow is used to connect the main supply pipe 24 to the intermediate chamber 20*b* in an embodiment of this invention illustrated in FIG. 3, but they may be connected together in other ways, such as connecting a straight pipe directly to the intermediate chamber 20*b*, according to the pressure, velocity of flow, etc. of liquid papermaking materials. The intermediate chamber 20*c* for supplying pressurized clear water located under the intermediate chamber 20*b* is connected both to all the pressurized clear water supply pipes 10 extending to all the cyclone separators 1 and to a main pressurized clear water supply pipe 25. The intermediate chamber 20*d* for re-collection located under the intermediate chamber 20*c* is connected both to all the re-collecting pipes 14 from all the cyclone separators 1 and to a main re-collecting pipe 26. The main re-collecting pipe 26 is connected to the main supply pipe 24 for liquid papermaking materials as required. All the outlet pipes 15 from all the cyclone separators 1 are connected to the intermediate outlet chamber 20*e*, and a main outlet pipe 27 is connected to it at its bottom.

Figure 3:
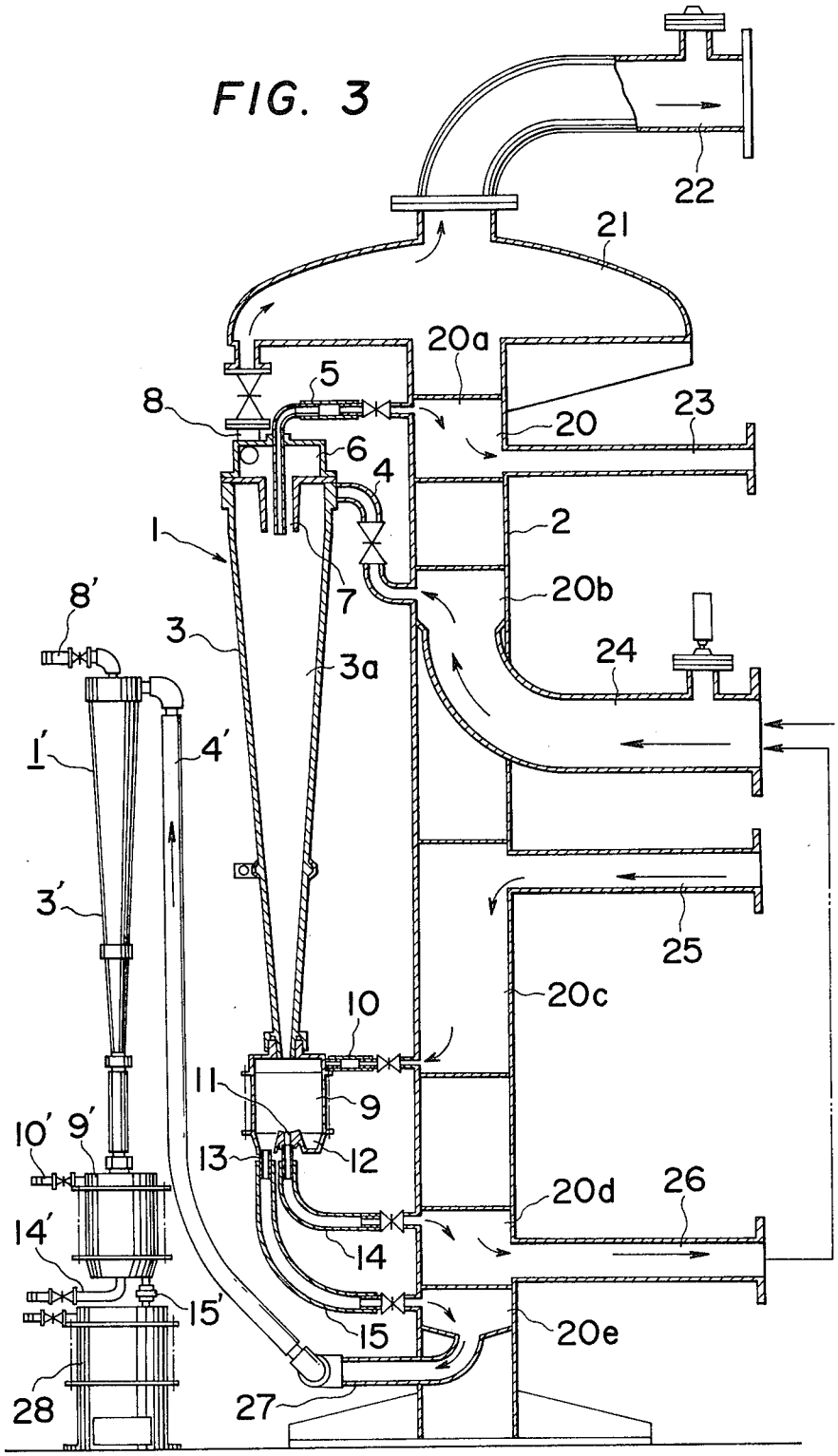
FIG. 3 is an enlarged side view, partly in vertical section, of the equipment of the invention.

Most of the things taken out of the cyclone vortex chamber 9 are heavy foreign matter. In the case of liquid papermaking materials, however, such heavy foreign matter may contain useful materials and therefore needs to be further separated and purified. Relatively light matter in the heavy foreign matter is taken out through the re-collecting port 11 and, as mentioned above, put in new liquid papermaking materials for further separation. On the other hand, relatively heavy matter in the heavy foreign matter is taken out through the outlet port 13 and, as shown in FIG. 3, further separated and purified to increase yield. The latter function is performed by secondary cyclone separators 1', about the same in construction as the aforesaid cyclone separator 1, which are connected so as to form a subsequent stage or stages for multistage operation. Each of the secondary cyclone separators 1' is connected to the end of the main outlet pipe 27 by a supply pipe 4' which enters a separator body 3'. By the way, each part of the secondary cyclone separator 1' is represented by the same numeral, with a prime (′), as the cyclone separator 1 because these separators are about the same in construction. The secondary cyclone separator 1' differs from the cyclone separator 1 in the following points: The secondary cyclone separator 1' in an embodiment illustrated in FIG. 3 does not have a means of removing light foreign matter because materials separated by it contain almost no light foreign matter. Also it has a sedimentation tank 28 for heavy foreign matter to which an outlet pipe 15' for heavy foreign matter is connected.

The equipment of the present invention which has construction as described above separates foreign matter from liquid papermaking materials as follows: By proper valve operations, liquid papermaking material is sent through the main supply pipe 24 to the intermediate chamber 20*b* from which it is distributed through the supply pipe 4 to each cyclone separator 1. The liquid papermaking material enters the cyclone chamber 3*a* tangentially, and therefore in the cyclone chamber 3*a* it comes down in a whirl. Light foreign matter concentrates in the center of the vortex, moves up with the flow, passes through the exhaust pipe 5, enters the intermediate chamber 20*a* for accumulating light foreign matter, and comes out of the equipment. On the other hand, heavy foreign matter sinks down, comes out of the cyclone chamber 3*a* and enters the cyclone vortex chamber 9.

Referring in detail to this function, pressurized clear water is sent into the cyclone vortex chamber 9, and pressure balance is maintained near the bottom of the cyclone chamber 3*a* between the clear water in the cyclone vortex chamber 9 and the liquid papermaking material in the cyclone chamber 3*a*. The liquid papermaking material on the border is diluted, and only heavy foreign matter with large specific gravity separates from the liquid papermaking material and drops into the cyclone vortex chamber 9.

In the cyclone vortex chamber 9, the clear water sent in under pressure through the pressurized clear water supply pipe 10 forms a vortex, which concentrates relatively light matter in the heavy foreign matter to its center and gathers relatively heavy matter on the circumference of the bottom. The relatively light matter in the heavy foreign matters enters the re-collecting port 11, passes through the re-collecting pipe 14, and comes in the intermediate chamber 20*d* for re-collection where it mixes with that from other cyclone separators 1. And the mixture further moves into the main recollecting pipe 26 and enters the main supply pipe 24 again. On the other hand, the relatively heavy matter in the heavy foreign matter comes out through the outlet port 13 and enters the intermediate chamber 20*e* for outlet, where it mixes with that from other cyclone separators 1. And the mixture is sent to secondary cyclone separators 1' to undergo similar separation and purification again. In the meanwhile, liquid papermaking material, from which foreign matter has thus been removed, comes out through the collecting nozzle 7, provided at the top of the cyclone chamber 3*a*, into the collecting chamber 6, and moves through the collecting pipe 8 into the collecting intermediate tank 21 at the top of the central structure 2, where it mixes with liquid papermaking material from other cyclone separators 1. And the mixture comes out through the main collecting pipe 22.

The present invention so far described in detail has the following advantages. Heavy foreign matter and light foreign matter are surely separated both from liquid papermaking materials and from each other because the cyclone separator has both the cyclone chamber and cyclone vortex chamber. The heavy foreign matter is further separated in the cyclone vortex chamber and part of it is re-collected and put in new liquid papermaking material to be purified, so that a larger recovery percentage of useful materials and better yield are obtained. It is possible to further increase the accuracy of separation by taking out the heaviest foreign matter and putting it in secondary cyclone separators.

In addition, a plurality of cyclone separators are disposed radially around the central structure partitioned into intermediate chambers, and all their pipes, such as the supply pipes, exhaust pipes, re-collecting pipes and outlet pipes, enter respective intermediate chambers which are connected to main pipes such as the main collecting pipe, main exhaust pipe and main supply pipe. This means that all materials are completely mixed in their respective intermediate chambers and they are supplied to the cyclone separators and taken out from the equipment in a uniform state.

Furthermore, where the intermediate chambers are provided inside the central structure, it is possible to make the whole equipment small and decrease the number of its parts.

As many different embodiments of this invention may be made without departing from the spirit and scope thereof. It is to be understood that the invention is not limited to the specific embodiments described above except as defined in the accompanying claims.

What is claimed is:

1. Equipment for separating foreign matter from liquid papermaking materials including a plurality of radially disposed cyclone separators defining a single stage, each of said cyclone separators comprising a separator body to the upper portion of which a supply pipe for said materials is tangentially connected and from which an exhaust pipe for light foreign matter extends, a collecting chamber for said materials disposed at the top of said separator body out of which collecting chamber a collecting pipe extends, and a cyclone vortex chamber disposed under said separator body with a pressurized fresh water supply pipe tangentially connected to its upper portion, with a re-collecting port provided at the center of the bottom of said vortex chamber, with a portion of said bottom around said re-collecting port made lower than the recollecting port and with an outlet pipe for waste connected to said portion of said bottom; a re-collecting pipe being connected to said re-collecting port; and a hollow structure disposed at the center of the circle described by said cyclone separators and spaced equidistantly therefrom, and partitioned into an intermediate chamber for accumulating the light foreign matter, an intermediate chamber for distributing the liquid papermaking materials, an intermediate chamber for supplying pressurized clear water, an intermediate chamber for re-collection, and an intermediate outlet chamber, said first-mentioned intermediate chamber being connected both to all the exhaust pipes for the light foreign matter extending from all the cyclone separators and to a main exhaust pipe for the light foreign matter, said second-mentioned intermediate chamber being connected both to all the supply pipes for said materials extending to all the cyclone separators and a main supply pipe for said materials, said third-mentioned intermediate chamber being connected both to all the pressurized clear water supply pipes extending to all the cyclone separators and to a main pressurized clear water supply pipe, said fourth-mentioned intermediate chamber being connected both to all the re-collecting pipes from all the cyclone separators and to a main re-collecting pipe, and said fifth-mentioned intermediate chamber being connected to all the outlet pipes from all the cyclone separators and to a common outlet pipe, said hollow structure being also provided at the top with a collecting intermediate tank.

2. Equipment as recited in claim 1, in which said single stage is provided with secondary cyclone separators of similar construction connected so as to form a subsequent stage.

3. Equipment as claimed in claim 2, wherein said main outlet pipe branches off to said secondary cyclone separators.

4. Equipment as claimed in claim 1, wherein the lower end of each exhaust pipe for light foreign matter is located at the upper central position of a cyclone chamber and slightly lower than said supply pipe.

* * * * *